US005906525A

United States Patent [19]

Melius et al.

[11] Patent Number: 5,906,525

[45] Date of Patent: May 25, 1999

[54] SWIM FINS FLEXIBLE BODY/BOOT, FIRM WING CAUDAL TAIL/BLADE AND POSSIBLE MODULAR CONSTRUCTION FOR VERSATILITY

[76] Inventors: John David Melius; Carolyn J. Melius; Alexandra F. Melius, all of 2725 Vista Ct., Waldorf, Md. 20603

[21] Appl. No.: 08/893,964

[22] Filed: Jul. 16, 1997

[51] Int. Cl.[6] ..... A63B 31/08

[52] U.S. Cl. ..... 441/64; D21/239

[58] Field of Search ..... 441/60–64; D21/239

[56] References Cited

U.S. PATENT DOCUMENTS

| | | | |
|---|---|---|---|
| 2,321,009 | 6/1943 | Churchill | 441/64 |
| 2,423,571 | 7/1947 | Wilen | 441/64 |
| 2,889,563 | 6/1959 | Lamb et al. | 441/64 |
| 3,072,932 | 1/1963 | Ciccotelli | 441/64 |
| 3,411,165 | 11/1968 | Murdoch | 441/64 |
| 4,055,174 | 10/1977 | LeVasseur | 441/64 |
| 4,541,810 | 9/1985 | Wenzel | 441/64 |
| 4,929,206 | 5/1990 | Evans | 441/64 |
| 4,934,971 | 6/1990 | Picken | 441/64 |
| 5,356,323 | 10/1994 | Evans | 441/64 |
| 5,421,758 | 6/1995 | Watson et al. | 441/64 |
| 5,597,336 | 1/1997 | Evans | 441/64 |

FOREIGN PATENT DOCUMENTS

| | | | |
|---|---|---|---|
| 1 245 395 | 9/1960 | France | 441/64 |
| 1 259 744 | 5/1961 | France | 441/64 |
| 2520624 | 1/1982 | France | 441/64 |

*Primary Examiner*—Jesus D. Sotelo
*Attorney, Agent, or Firm*—Nixon & Vanderhye PC

[57] ABSTRACT

A swim fin that has the streamlined design of an aquatic fish or mammal with the foot pocket and flexible shaft forming a proportional and similar shape to the body of a fish. The fin is a wing-like shape separate but connected to the shaft similar to the caudal fin of a fish. This streamlined design provides an efficient form of propulsion using only power strokes and the principles of lift similar to fish. Also the tips of the stiff caudal fin create vortices to reduce drag. The flexible shaft is made of a material with a physical "memory" so that it springs back to its original manufactured shape after it flexes to produce a secondary "kick" for the swimmer. This overall "fish or whale" shape also allows for the possibility of a modular construction, if desired, where the flexible caudal shaft and stiff caudal fin can be exchanged with ones of alternative size, shape, material and design so that the fin can be adapted to each swimmer's body type, muscle type, swimming style, and aquatic conditions.

11 Claims, 5 Drawing Sheets

FIG. 6
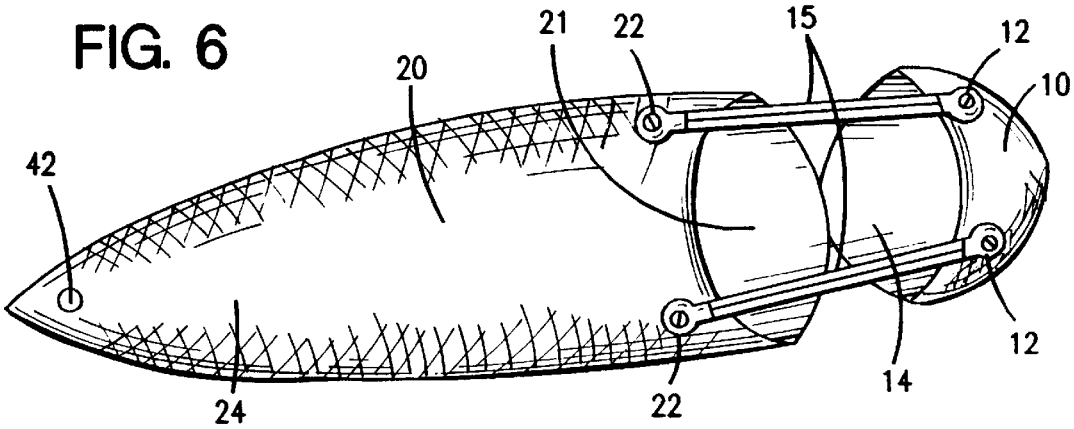
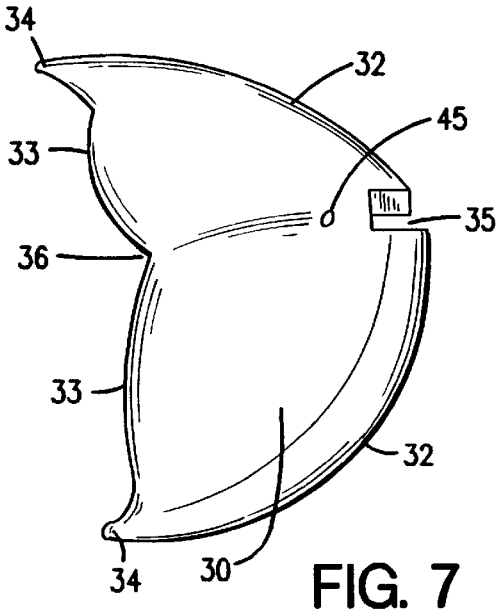
FIG. 7
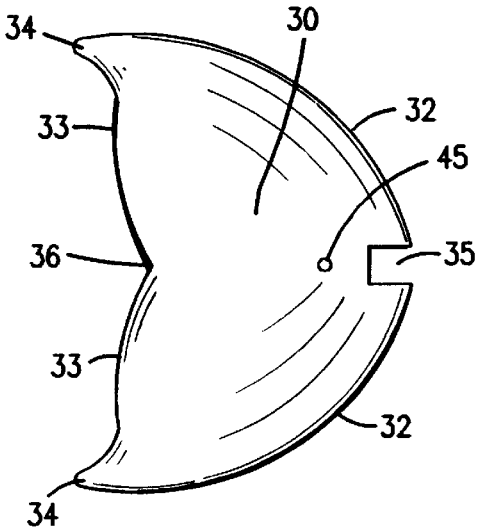
FIG. 8
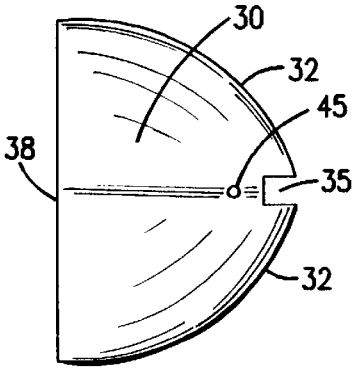
FIG. 9
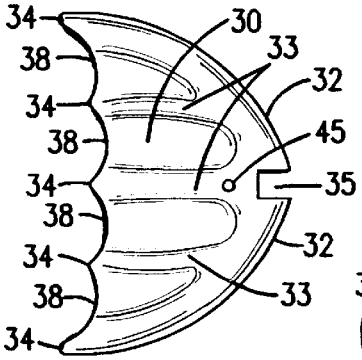
FIG. 10
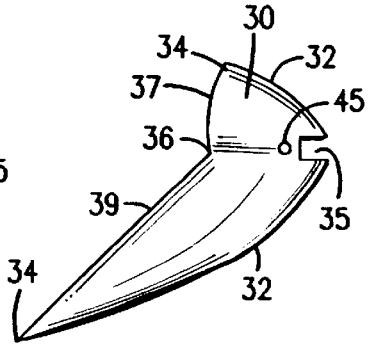
FIG. 11

SWIM FINS FLEXIBLE BODY/BOOT, FIRM WING CAUDAL TAIL/BLADE AND POSSIBLE MODULAR CONSTRUCTION FOR VERSATILITY

BACKGROUND—FIELD OF INVENTION

This invention relates to a unique swim fin that differs considerably from swim fins of the prior art in its basic concept of and in the configuration of the boot into a flexible "Fish body" (boot/body) with a stiff caudal fin or tail (tail/blade) that act as a wing in producing "Lift" as a form of propulsion. This "Fish body" type of structure also allows for modular construction and great flexibility in the combining of different tail/blades to flexible boot/bodies to adapt to the different swimming conditions, styles, and body types of swimmers. This invention specifically improves the method of propulsion from one of resistance to one of "lift" propulsion, it improves the fluid dynamic flow of water to increase "still" water contact and therefore efficiency, it improves the bio-mechanical relationship to natural human kicking motions, it improves the propulsion phase of the fin from a power/recovery cycle to a power/power cycle, it improves the propulsion by employing a recoil memory material in the flexible body/boot that delivers a rebound kick at the change of direction in kicking.

BACKGROUND OF THE INVENTION

Many different animals use various forms of propulsion in water. Most swim fins are based on the "webbed foot" design that functions in a similar manner to an oar in the water. It therefore has a "power stroke" when pushing against the resistance of the water and a recovery stroke in which it attempts to move without resistance to a new place. Purely aquatic animals such as fishes and whales use a more efficient system of propulsion in the water based on "lift" from a rigid "wing type" caudal fin or tail that focuses a stream of water. A close study of aquatic animals produced few examples where the caudal fins were flexible themselves because the flexed shape loses its "Lift" ability. These stiff caudal fins also produce vortices at their tips that reduce drag in the lateral movement necessary for propulsion while also decreasing the interference of the wake of one fin on another (the reason that they can swim in "schools" without great effect on the propulsion of each individual animal.) These animals instead have a flexible shaft that moves the stiff caudal fin through the water like a moving wing-shape. A comparison of the propulsion systems would be that of an oar or paddlewheel as resistance propulsion compared to the "Lift-type" propulsion from a propeller. Flexible propellers are not efficient or common. Flexible caudal fins or tales are also inefficient. All of the prior art uncovered in preliminary patent searches in the United States Patent Office is exemplary of flexible caudal fins. A second advantage to the aquatic propulsion system in this instant invention is that it has only power strokes and no recovery strokes because the shaft flexes but the tail/blade remains effective with movement in any direction because it maintains its wing-like shape. Therefore, greater propulsion can be generated with less effort.

Flexibility is important to the reduction of muscle fatigue in the swimmer. However, the amount of flexibility necessary for each swimmer varies according to swimming style and muscle mass and type. By varying the type of flexible body/boot, the swimmer could maintain maximum physical power in relation to muscle fatigue.

Heretofore, many designs have been created for swim fins for humans to help in their propulsion through the water, but each has one or more significant drawbacks. This instant invention is a design based on an understanding of the bio-mechanics of aquatic animals and humans and one that can also be modular for new configurations that adapt to different muscle types, body types and swimming conditions. Prior art has forced the swimmer to adapt to the fin as opposed to allowing various configurations of the fin to adapt to the swimmer.

Turbulent water is counter productive to both resistant and lift type propulsion and should be reduced to improve efficiency which this instant invention accomplishes through improved fluid dynamics.

As exemplary of some of the prior art, the following patents were uncovered in preliminary patent searches in the United States Patent Office:

U.S. PATENTS

One such swim fin, shown in U.S. Pat No. 2,321,009 to Churchill (1943) shows swim fins that create a dolphin tail when put together. This design would be comparable to cutting a dolphin's tail in half and see if it could swim or cutting off half of a tail wing on an airplane. It loses its balanced "lift" design that focuses water in a stream in the center of the tail and is inherent to the whole tail shape of a dolphin. Secondly, it has very hard edged surfaces which do not promote good fluid dynamic flow of water and the flexible fin distorts to deteriorate the lift potential. This flexible tip does not form vortices that help to lessen drag in lateral movement of the fin and curb interference between fins.

Wilen, in U.S. Pat. No. 2,423,571 (1947) shows a swimming tail (swim fin) that does take into account the basic shape of aquatic caudal fins, but doesn't create a fluid dynamic flexible body that could move this stiff fin without distorting it. Instead this swimming tail is only the tail section and must therefore be flexible itself. However, this flexing distorts the "lift" surfaces and therefore decreases its lift potential. This design is also meant to have a power phase and a recovery phase in the normal swimming cycle. With that in mind the under side of the foot is crisscrossed with a waffle pattern to create vortices to reduce drag but this also reduces "Lift." This flexible tip does not bring about vortices that help to ease drag in lateral movement of the fin and reduce interference between fins.

Murdoch, in U.S. Pat. No. 3,411,165 (1968) shows a swim fin with three rigid ribs forming a frame that hold two flexible membranes between them. This rigid frame produces quick fatigue for swimmers. It does not have a flexible tail body that allows for changing angles in the contact of the fin with "still" water. It also does not have good "lift" properties and works almost completely with resistance to the water. This flexible fin tip doesn't generate vortices that help to reduce drag in lateral movement of the fin and alleviate interference between fins.

LeVasseur, in U.S. Pat. No. 4,055,174 (1977), shows a swimming system that includes a swim fin shaped like a dolphin's tail fin. Although this system does observe very good fluid dynamics, it does not adapt those fluid dynamics to the bio-mechanical aspects of humans. By connecting both feet together, it forces the human swimmer to kick in an unnatural manner. It also stops the possibility of walking in these fins. It also has vents that cause a recovery phase along with a power phase in the swimming cycle.

Wenzel, in U.S. Pat. No. 4,541,810 (1983), shows a swim fin shaped like a dolphin's or whale's tail fin. Like the previous patent, it does not adapt to the bio-mechanical aspects of humans. By connecting both feet together, it forces the human swimmer to kick in an unnatural manner. It also stops the possibility of walking in these fins. This art does show the important streaming or focusing of the water by this "whale tail" shape but because these fins are flexible in shape instead of having a flexible tail, they are not as efficient in giving propulsion by lift as a more rigid wing shape. This flexible fin tip does not create vortices that help to lower drag in the lateral movement of the fin and diminish interference between fins.

Evans, U.S. Pat. No. 4,929,206 (1990), shows a swim fin with flexible fin members having movable tips. This art has more lift on the power stroke, but still depends on a recovery stroke in its propulsion cycle. It has less lift than a wing shape and depends on a recoil of the material for part of its propulsion. However, the lack of a flexible tail and fixed wing shape means a loss of lift. This flexible tip does not create vortices that help to cut back drag in the lateral movement of the fin and assuage the interference between fins.

Evans, U.S. Pat. No. 5,356,323 (1994), shows a swim fin with flexible fin members having movable tips and a closed shoe that gives somewhat better fluid dynamics. The fluid dynamics are not as great as a sloping body/tail section would be. This art has more lift on the power stroke, but still depends on a recovery stroke in its propulsion cycle. It has less lift than a wing shape and depends on a recoil of the material for part of its propulsion. However, the lack of a flexible tail and fixed wing shape means a loss of lift. This flexible tip does not create vortices that help to constrict drag in the lateral movement of the fin and reduce interference between fins.

Watson et al., U.S. Pat. No. 5,421,758 (1995), show a scuba fin that has the fin section separated from the foot pocket with a high thin shaft. Although this caudal shaft reduces drag, it is not flexible as in aquatic animals and thus necessitates a flexible fin which deforms to reduce propulsion produced from lift. It still depends on a propulsion cycle of power stroke from resistance and a recovery stroke, and this wastes energy.

Evans, U.S. Pat. No. 5,597,336, (1997), shows a swim fin that is configured with an open instep to accommodate a plurality of foot sizes. This art is better for the person's foot than for swimming. It does not have good fluid dynamics and it does not have a flexible caudal tail which means that it must use a flexible fin. This reduces the propulsion from lift and creates the need for a power/recovery cycle. This flexible tip does not create vortices that help to reduce drag in lateral movement of the fin and curtail interference between fins.

Foreign Patents

Patent Number: 1.245.395
Country: France
Class: 441
Subclass 64
Issued: Sep. 9, 1960
Filed: Sep. 9, 1960
Title: unknown
Inventors: MM. Bouchat et Dumas This art shows fluid dynamics of aquatic animals but does have a flexible caudal tail and thus has a flexible blade. Because these fins are flexible in shape instead of having a flexible tail with stiff caudal fins, they are not as efficient in giving propulsion by lift as a more rigid wing shape and do not create desired vortices at their tips to lower drag and reduce interference with each other when they are worn on each foot.

Patent Number: 1.259.744
Country: France
Class: 441
Subclass: 64
Issued: May 5, 1961
Filed: May 5, 1961
Title: PI. unique
Inventors: M. Boudkevitch shows art that has three relatively rigid ribs that hold two flexible membranes between them. This rigid frame produces quick fatigue for swimmers. It does not have a flexible tail body that allows for changing angles in the contact of the fin with "still" water. It also does not have good "lift" properties and works almost completely with resistance to the water.

Patent Number: 2520624
Country: France
Class: 441
Subclass: 64
Issued: Jan. 29, 1982
Filed: Jan. 29, 1982
Title: Sectional swim fin
Inventors: not discernable from the patent cover sheet with our best examination shows a swim fin shaped like a dolphin's or whale's tail fin. Like the previous patent, it does not adapt to the biomechanical aspects of humans. By connecting both feet together, it forces the human swimmer to kick in an unnatural manner. It also stops the possibility of walking in these fins. Because these fins are flexible in shape instead of having a flexible tail, they are not as efficient in giving propulsion by lift as a more rigid wing shape and do not generate desired vortices at their tips to restrict drag and decrease interference with each other when they are worn on each foot.

None of the above inventions and patents, taken either singly or in combination, is seen as the instant invention as claimed.

OBJECTS AND ADVANTAGES

It is an object of the invention to provide a configured swim fin that has the shape of a fish. The heel piece would constitute the head of the fish (head/heel.) The boot portion of the fin would constitute the flexible body of the fish (body/boot.) The stiff caudal fin would be the stiff caudal fin of this swim fin (tail/blade.)

It is another object of this invention to provide a swim fin with the fluid dynamics of an aquatic animal.

It is still another important object of the invention to mimic the superior propulsion system exhibited by purely aquatic animals by using a stiff caudal fin as a type of "wing" that will produce lift. This stiff caudal fin also focuses the water passing over the leading edge of the fin into a stream that emanates directly from the center of the trailing surface of the stiff caudal fin.

It is another object of the invention to have stiff caudal fins with tips that create vortices that reduce the drag on the fin in its lateral movement while also lowering the interference wake that would interrupt the "still" water necessary for optimum production of each fin.

It is another object of this invention to aid the swimmer by creating a relationship to the swim fin that allows normal human bio-mechanics to function within the frame work of swimming for maximum propulsion by angling the foot within the body/boot.

It is another important object of this invention to aid the swimmer by creating a relationship to the swim fin that allows normal human bio-mechanics to function within the frame work of swimming for maximum propulsion by creating a modular system of construction that can be changed to adapt to the swimmer's body type and swimming conditions by changing head/heel, the body/boot or the tail/blade, or any combination of these three parts.

It is another object of this invention to provide a propulsion system that uses less resistance and more lift in every phase of the swimming motion to maximize the return for effort for the swimmer.

It is another object of this invention to provide assistance to the swimmer by the use of a material in the body/boot that "rebounds" back to its original shape giving the swimmer a secondary "kick" from the material itself retrieving its "material memory." This would retrieve some of the effort lost in the flexing of the material that would occur to lessen the fatigue of the swimmer.

Generally, the swim fin comprises three parts that mimic a fish. The head of the fish becomes the heel piece of the "swim fin," the flexible body of the fish becomes the boot (foot well) and flexible tail shaft, and the stiff caudal fin of the fish becomes the stiff wing-shaped blade that resembles a stiff caudal fin of a fish or the tail of a whale (tail/blade.) This improved aquatic shape gives improved fluid dynamics and improved propulsion with less energy needed.

These and other objects of the invention will become apparent from a consideration of the ensuing description and accompanying drawings.

BRIEF DESCRIPTION OF THE DRAWINGS

FIG. 6 is a plan drawing of the head/heel part, the boot/body and flexible shaft with a clear illustration of the securing post hole used in possible modular formation for the swim fin.

FIG. 7 is a perspective drawing of the tail/blade illustrating the stiff "wing-shaped" form with the modified mortice and securing hole for possible modular construction.

FIG. 8 is a plan drawing illustrating the tail/blade with its vortex causing tips on the trailing surface, focus grove to help funnel water into a stream, and modified mortice and securing hole. This design is based on a possible dolphin or whale tail design.

FIG. 9 is a plan drawing illustrating the tail/blade with its oversized flexible trailing surface to help funnel water into a stream, and modified mortice and securing hole. This design was studied from "cruising" fish with gentle caudal tail action.

FIG. 10 is a plan drawing illustrating the tail/blade with its vortex causing tips on the trailing surface, the secondary "support" ribs and flexible trailing surface shapes between the ribs help funnel water into a stream, the vortex creating tips along the back edge reduce drag, and a modified mortice and securing hole. This design was studied from seals with powerful kick and thrust techniques.

FIG. 11 illustrates another possible modular tail/blade based on a shark caudal fin. This plan drawing illustrates the asymmetrical design, the vortex creating tips, the modified mortice and securing hole.

DETAILED DESCRIPTION OF THE PREFERRED EMBODIMENTS

Figure 1:
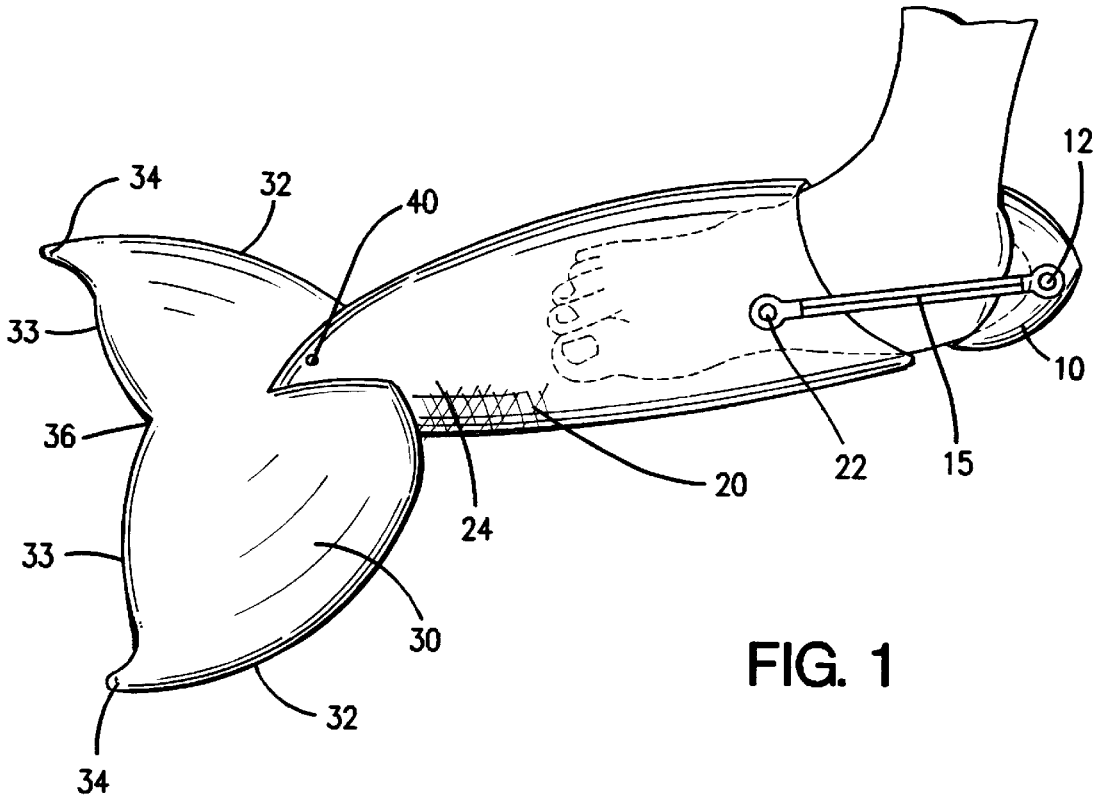
FIG. 1 is a perspective view of one embodiment of the invention, illustrating the foot in relation to the "fish" shape of the swim fin. It also illustrates one possible configuration of the head/heel, body/boot, and tail/blade parts of this invention.

Referring to the figures of drawings wherein like numerals of reference designate like elements throughout, it will be seen that the unique swim fin is composed of several parts in a possible modular construction: the head/heel 10, the elastic strap 15, the body/boot 20, and the tail/blade 30. This shape and configuration enables the realization of three major benefits. It produces a smooth fluid dynamic flow and "lift" propulsion. It produces a recoil kick to give the swimmer a secondary kick with only power strokes (and no recoil stroke necessary.) In the modular form, it produces an adaptable arrangement for the swimmer to combine the best elements of the head/heel 10, the body/boot 20 and the tail/blade 30 to enable the natural bio-mechanics of the swimmer to perform in the chosen aquatic situation. The head/heel 10 is connected to the elastic band 15 by a connecting post 12, the elastic band is also connected to the body/boot 20 by another connecting post 22, and the tail/blade 30 is fastened securely with another connecting post 40.

Figure 2:
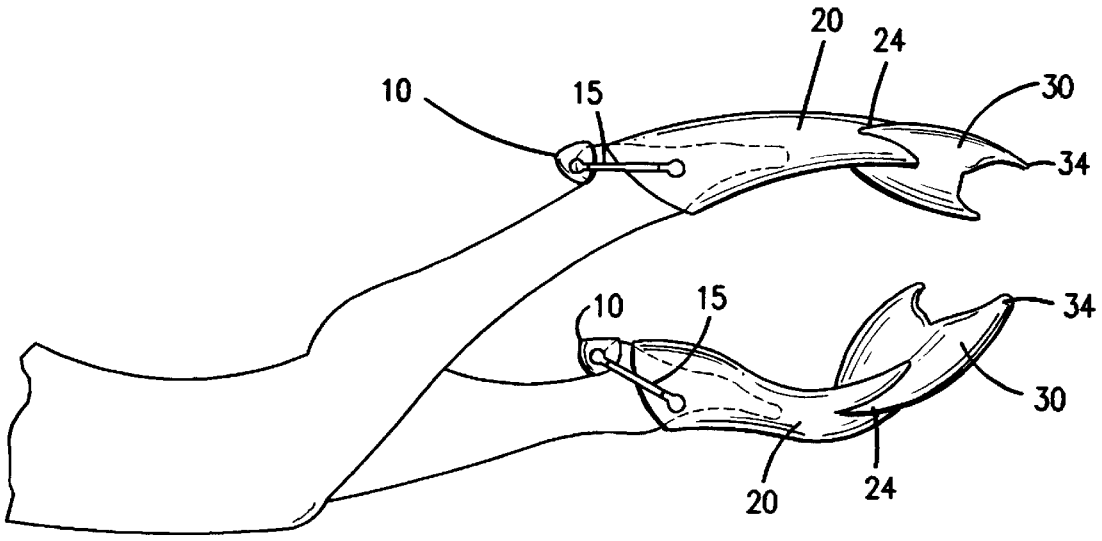
FIG. 2 is an illustration of the relationship between the body of the swimmer and the swim fins while in action. It shows the angle of the foot to the boot/body, and the flexible caudal shaft. It also shows the stiff nature of the caudal fin with its vortex creating tips.

The overall shape and form of this swim fin avails itself of the superior fluid dynamics found in the shapes of aquatic animals such as fishes or whales. This shape promotes the smooth flow of water allowing the wing shape of the tail/blade 30 to produce "lift" as a form of propulsion. The tip 34 of the tail/blade 30 is relatively pointed to produce vortexes in order to reduce drag in the movement of the fin through the water, and to reduce interference with the other fin used by a swimmer on the second foot (this can be seen better next in FIG. 2.) This is the same principle used by fish in their stiff caudal fins and one reason that they can swim in schools without disrupting the swimming of each other. Fish and whales using this form of propulsion only have power strokes in this system and don't need a recovery stroke as is necessary in resistance type propulsion.

Figure 3:
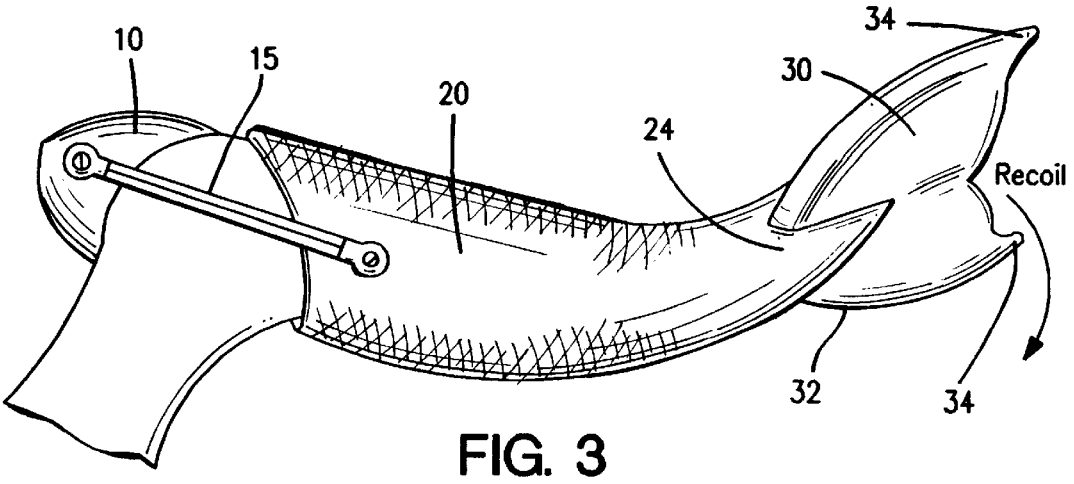
FIG. 3 is a clear example of how the flexible shaft bends during the downward movement of a swimming kick.

Another important aspect of the body/boot is the flexible shaft 24 that assists in making the kicking motion of the swimmer more effective and efficient. This flexible shaft 24 could possibly be constructed as a solid or hollow shape with or without ribs or supports. This flexible shaft 24 allows for bending as the swimmer begins each phase of the kick which helps slow fatigue in the muscles. But the effort is not lost in the bending because the flexible shaft 24 of the body/boot 20 is made of a material that has a "memory" and therefore "recoils" from the bend to give the swimmer a secondary "kick" due to the nature of the material (probably polyurethane) as seen in FIG. 3. (Notice also that this possible version of the invention does not use the modular system for connecting the body/boot 20 and the tail/blade 30. It could also possibly have the head/heel 10 attached as a single unit to the body/boot 20 and the tail/blade 30.)

Figure 4:
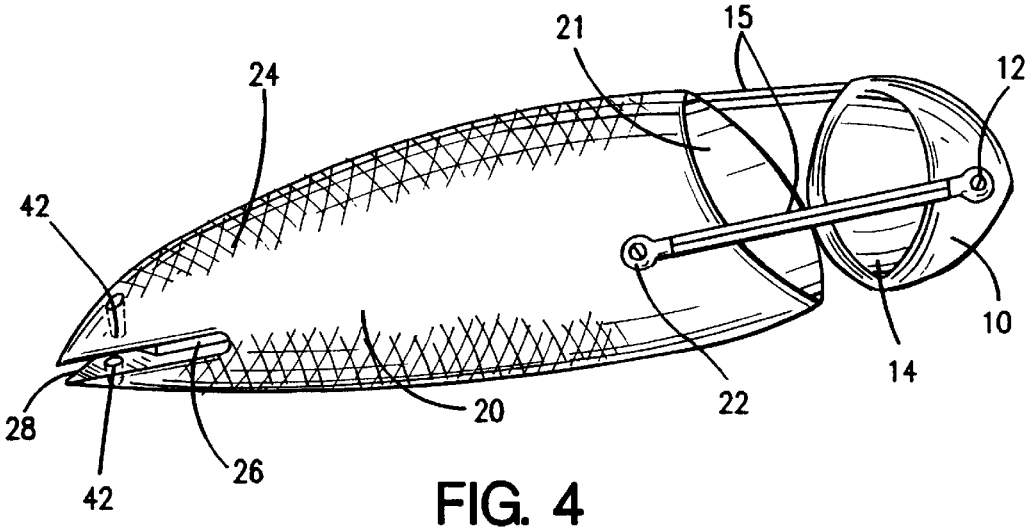
FIG. 4 is a side perspective drawing of the body/boot with flexible shaft demonstrating the modified tenon and securing slot used in a possible modular version to attach to some possible version of the wing-shaped tail/blade, the elastic band or bungee® cord(s), and the head/heel assembly.
Figure 5:
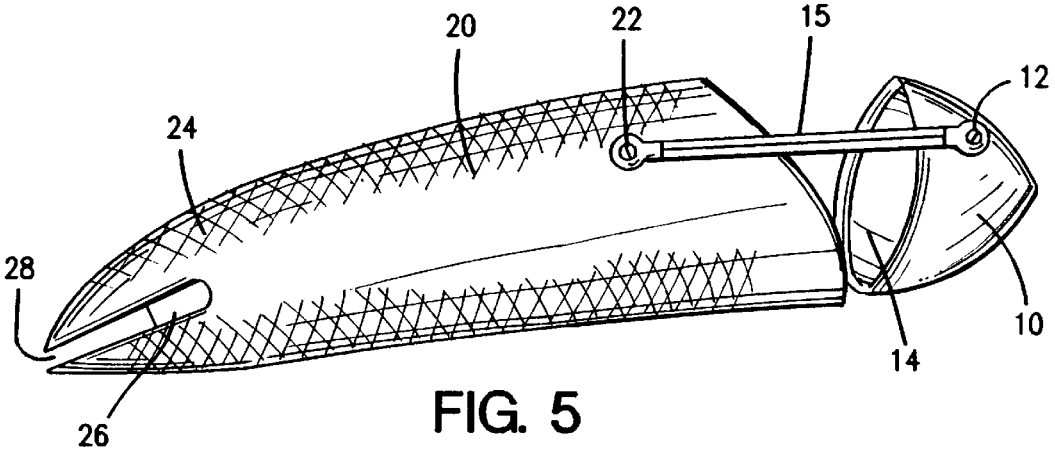
FIG. 5 is a side elevation drawing of the head/heel part, the boot/body and flexible shaft with a clear illustration of the securing slot and modified tenon used in possible modular formation for the swim fin.
Figure 12:
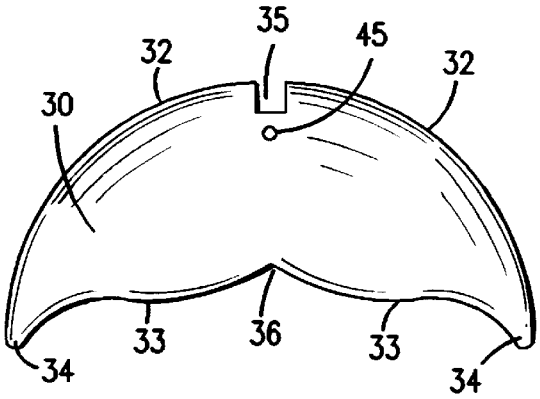
FIG. 12 is a frontal elevation of the tail/blade dolphin style.

The possible modular construction of this swim fin could be accomplished by using an elastic band 15 to connect the head/heel 10 (which could be made of silicon, polyurethane or other soft pliable sturdy material in several different shapes as options for swimmers) to the body/boot 20 with securing posts. The body/boot 20 could possibly attach to the tail/blade 30 by means of a modified mortice and tenon joint 26 and 28 to be held secure by a securing post 40. The modified tenon 26 can best be seen in FIGS. 4 and 5. The securing slot 28 allows the leading edge 32 of the tail/blade 30 to merge into the body/boot 20 in a seamless and fluid dynamically sound manner. These illustrations also show where the possible securing post hole 42 might be placed to hold the securing post 40 which will secure the tail/blade 30 firmly to the flexible shaft 24 of the body/boot 20.

FIG. 6 demonstrates the symmetrical and sheer fluid dynamic shape of the head/heel 10 and the body/boot 20 as seen in a plan drawing. The foot well 21 and the heel well 14 are also clearly shown in this illustration with the elastic bands 15 connecting them on both sides.

FIGS. 7 through 15 and 17 through 20 demonstrate the versatility of a modular system by allowing many different design of a tail/blade 30 to interlock with a body/boot 20. Although the types of propulsion vary with these different designs, it is a matter of application not principle in the differences. Because of their interchangeable nature, they are all cited as a single possible modular part with the same name and number, tail/blade 30.

There are certain aspects that will probably be common to all tail/blades in this configuration. They can be seen when looking at FIG. 7, the perspective drawing of the dolphin/whale style possible tail/blade 30, which shows the thickness of the leading edge 32 as seen in the modified mortice 35. The securing post hole 45 in the tail/blade 30 falls into a direct line with the securing post hole 42 in the body/boot 20 when the two pieces are coupled correctly allowing the securing post 40 to couple the two parts firmly. To correctly couple this possible modular system the securing slot 28 is held open to allow the leading edge 32 of the tail/blade 30 to slide into the securing slot 28 until the modified mortice 35 touches the modified tenon 26 on the body/boot 20.

The possible variations in tail/blade designs are more evident in the dolphin/whale design tail/blade 30 in FIGS. 7, 8, 12, and 17 which has a very firm but thin trailing surface 33 tapering slowly down from the leading edge 32 . The trailing surface 33 in this design also has a focus grove 36 that acts to allow the water to stream to the point of least resistance through it. This channels water directly off the center section of the tail/blade 30 and gives greater concentrated thrust towards the center of the tail/blade 30. The tips 34 of the tail/blade 30 create vortices that reduce drag on the tail/blade 30 and reduce the waves of water that would interfere with lift for a second swim fin worn by the swimmer as seen in illustration 2.

Figure 13:
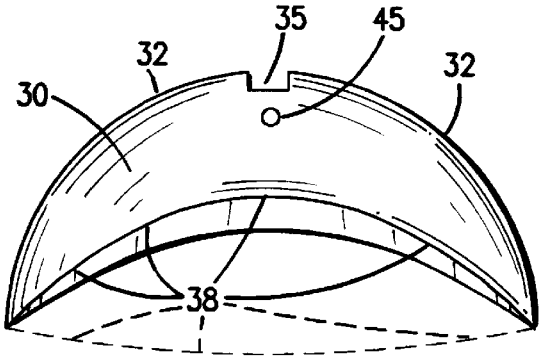
FIG. 13 is a frontal elevation of the tail/blade cruising fish style. It illustrates the flexible trailing surface and its alternate position when traveling in the down direction.
Figure 18:
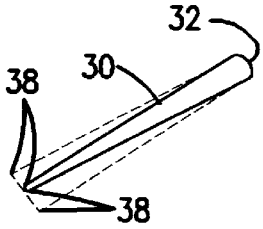
FIG. 18 side elevation of cruising fish style tail/blade illustrating the "lift" potential of its shape. It again illustrates the flexible membrane creating the trailing part of the tail/blade.

The cruising fish design tail/blade 30 found in FIGS. 9, 13, and 18 show a flexible trailing surface 38 that is oversized to allow for a focusing of the water produced by lift into the center by the groove formed by the flexing material as seen in FIG. 13. In FIG. 18 a possible variation of the amount of flex is illustrated by dashed lines of the flexing trailing surface 38. The leading edge is rounded and broader as in a wing as also seen in FIG. 18.

Figure 14:
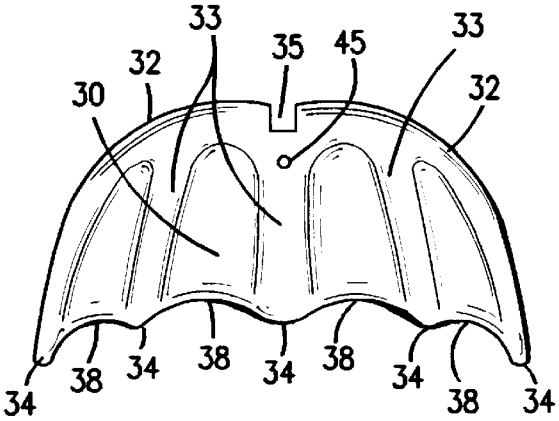
FIG. 14 is a frontal elevation of the tail/blade seal style. It demonstrates the thicker support rib sections clearly.
Figure 19:
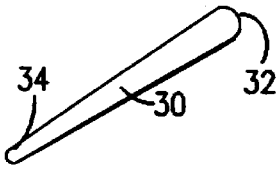
FIG. 19 side elevation of seal style tail/blade illustrating the "lift" potential of its shape and greater rigidity.

FIGS. 10, 14, and 19 show a design based on seal's rear flippers with modification to maintain a wing shape for superior lift. This tail/blade 30 variation has supporting "rib" material 33 running through the tail/blade 30 that is thicker and stiffer than the rest of the tail/blade 30. The rest of the material in the trailing surface 38 is made of a thinner material and therefore more flexible.

Figure 15:
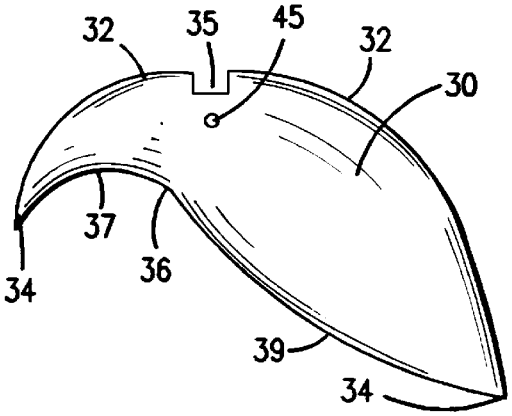
FIG. 15 is a frontal elevation of the tail/blade shark style. It illustrates the "S" curve of the trailing surface with its asymmetrical shape.
Figure 16:
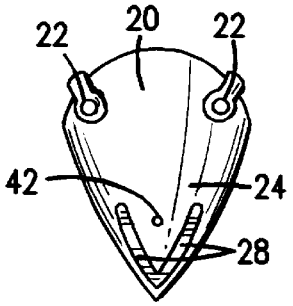
FIG. 16 frontal elevation drawing of the boot/body with flexible shaft, securing hole and securing slot.
Figure 20:
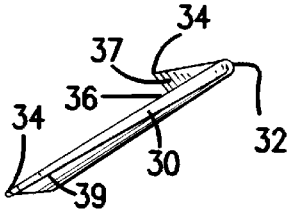
FIG. 20 side elevation of shark style tail/blade illustrating the "lift" potential of its shape. It also illustrates the opposing directions in the shape of the fin from one asymmetrical side to the other.

FIGS. 11, 15, and 20 demonstrate one of the unusual possibilities that can exist in this modular system of swim fins with the shark design of tail/blade 30. It has an asymmetrical shape with and "S" curve from one side to the other in the trailing surface 37 and 39. The asymmetrical shape would produce a streaming of water in both power strokes, but would alternate where the streaming took place with each swing in direction.

Figure 21:
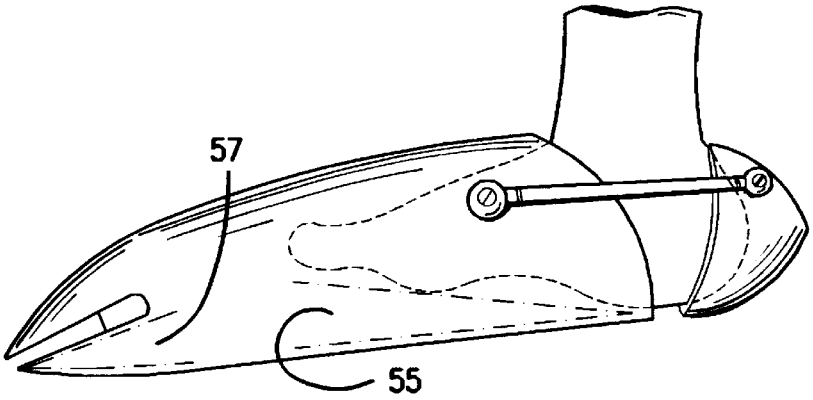
FIG. 21 is an illustration of the possible angles for both the angle of the foot in the boot/body and the angle of the tail/blade in relation to the boot/body in a horizontal position.
Figure 17:
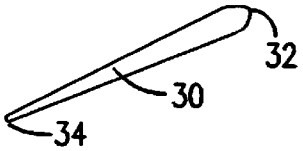
FIG. 17 side elevation of dolphin style tail/blade illustrating the "lift" potential of its shape.

FIG. 21 shows the possible variables in the angles 55 that the foot could be placed into the body/boot 20. By having different possible angles available for different swimmers, the body/boot 20 could better adapt to the best bio-mechanic swim technique for each swimmer and tail/blade 30 attachment combination. In general, the angle should be as large as is comfortable in walking and yet give the foot the ability to move the body/boot 20 and therefore the tail/blade 30 with a bent ankle instead of one that is trying to extend the toes into a "tip-toe" position for maximum thrust.

In FIG. 21 a possible angle for the tail/blade 30 is also represented. This angle should maximize the ability of the ankle to be bent and yet have the best thrust and vector possible from the tail/blade 30. It must also accommodate and help stabilize the swimmer if the need should arise to walk in this swim fin.

Figure 22:
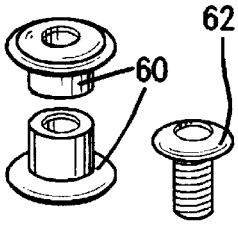
FIG. 22 is a drawing of brass bushings and a stainless steel screw that could compose the securing post in the other possible illustrations.

A possible securing post is illustrated in FIG. 22 comprising of two brass bushing 60 that are threaded to receive a stainless steel screw 62. These bushings would be placed through both the securing holes 42 on the body/boot 20 to reach into the securing hole 45 in the body/boot 20, for example, to secure the tail/blade 30 to the body/blade 20 in a very firm manner. Similar securing posts (60 and 62) would be used to fasten the elastic band 15 to the body/boot 20 and the head/heel 10.

Although the description above contain many specificities, these should not be construed as limiting the scope of the invention but merely providing illustrations of some of the embodiments of this invention. Various other embodiments and ramifications are possible within its scope. For example, any stiff caudal fin of any type of fish or tail of any species of whales could be a design for the tail/blade 30 of this invention. Another example would be the size, length, exact shape, material and construction of the flexible shaft 24 portion or the boot portion of the boot/body 20 and head/heel 10 which could vary widely.

Thus, there has been disclosed a unique configured swim fin that has superior fluid dynamic shape (based on the designs of natural selection in aquatic animals), has a superior propulsion system based on lift instead of resistance, uses every stroke of the fin as a source of propulsion instead of spending half the time in a recovery mode, has a flexible shaft that returns a kick from the recoil of its material to the swimmer's kicking stroke, has the ability to be modular in construction which gives the swimmer tremendous ability to adapt the swim fin to their own bio-mechanical make-up, swimming style and swimming conditions.

Various modifications may be made to the disclosed fin invention, as for example, by varying the manner of securing the different aforementioned parts together.

We claim:

1. A swim fin comprising:

a flexible boot member having a foot pocket; and a tail secured to the flexible boot member, the tail having wing-shaped cross-section, wherein the tail is asymmetrically shaped.

2. A swim fin according to claim 1, wherein the wing-shaped cross-section is defined by a leading edge engaging the flexible boot member and a trailing edge at an opposite end, the leading edge being rounded and broader than the trailing edge.

3. A swim fin according to claim 2, wherein the tail is releasably secured to the flexible boot member.

4. A swim fin according to claim 2, wherein the tail includes tips at outermost ends of the trailing edge, the tips are pointed thereby producing vortexes that reduce drag.

5. A swim fin according to claim 1, wherein the boot member is formed of polyurethane.

6. A swim fin according to claim 1, wherein the wing-shaped cross-section is defined by a leading edge engaging the flexible boot member and a trailing edge at an opposite end, the tail tapering down in thickness from the leading edge to the trailing edge.

7. A swim fin according to claim 6, wherein the tail further comprises a focus groove in the trailing edge, the focus groove allowing water to stream to a point of least resistance.

8. A swim fin according to claim 6, wherein the tail further comprises a plurality of ribs extending between the leading edge and the trailing edge.

9. A swim fin according to claim 1, wherein the tail is shaped in an S curve along the trailing edge.

10. A swim fin comprising:

a flexible boot member having a foot pocket; and a tail secured to the flexible boot member, the tail having a wing-shaped cross-section, wherein the tail is secured to the flexible boot member with a mortice and tenon joint.

11. A swim fin comprising:

a flexible boot member having a foot pocket;

a tail secured to the flexible boot member, the tail having a wing-shaped cross-section; and a heel member secured to the flexible boot member with an elastic strap.

* * * * *